10/22/85 OR 4,548,317

United States Patent [19]

Weaver

[11] Patent Number: 4,548,317

[45] Date of Patent: Oct. 22, 1985

[54] BOTTLE MULTI-PACKAGE AND MULTI-PACKAGING DEVICE

[75] Inventor: William N. Weaver, Northbrook, Ill.

[73] Assignee: Illinois Tool Works Inc., Chicago, Ill.

[21] Appl. No.: 553,004

[22] Filed: Nov. 17, 1983

[51] Int. Cl.[4] ..... B65D 71/00

[52] U.S. Cl. ..... 206/162; 206/150; 206/158; 294/87.2

[58] Field of Search ..... 206/145-158, 206/199, 427, 161, 162; 220/23.4; 294/87.2, 87.28

[56] References Cited

U.S. PATENT DOCUMENTS

| | | | |
|---|---|---|---|
| 3,268,070 | 8/1966 | Cunningham | 206/150 |
| 3,325,004 | 6/1967 | Wanderer | 206/150 |
| 3,341,245 | 9/1967 | Wolford | 206/150 |
| 3,504,790 | 4/1970 | Owen | 294/87.2 |
| 3,608,949 | 9/1971 | Owen | 206/150 |
| 3,727,754 | 4/1973 | Cunningham | 206/150 |

*Primary Examiner*—William T. Dixson, Jr.
*Assistant Examiner*—Jimmy G. Foster
*Attorney, Agent, or Firm*—Thomas W. Buckman

[57] ABSTRACT

A package for bottles utilizing a single sheet-like resilient carrier device positioned midway the body of the bottles and individually grouping the bottles. A pair of handles are created in diagonally opposite aperture designed to move upwardly between ranks upon association of bottles with the apertures.

4 Claims, 3 Drawing Figures

BOTTLE MULTI-PACKAGE AND MULTI-PACKAGING DEVICE

This invention is concerned with packages of bottles and the like, containers and carriers therefor. Such bottles are conventionally of the type including a generally cylindrical reduced neck portion diverging to a larger body portion. The neck openings may be closed in a variety of ways such as screw caps, pressed-on caps, plastic closures, etc. The closure is an important element because the contents of most of the bottles are pressurized and thus a reliable seal must be maintained. These types of bottles or containers may be and have been assembled in multi-packages through various forms of carriers or retainers. The containers are typically arrayed in a rank-and-row relationship usually in two parallel rows of three ranks and retained in that array for handling.

Typical of such efforts to multi-package such containers are paperboard wrap-arounds or partial wrap-arounds which either completely surround and encase the array, or partially surround the array in such a manner to prohibit in advertent removal of the bottles during handling or storage. Such paperboard packages obviously have several disadvantages, a primary disadvantage being that the wrap-around material detoriates due to moisture and thus the integrity of such a package is reduced considerably. Other packaging concepts utilized for such bottles include a top gripping carrier such as generally described in U.S. Pat. No. 4,139,094. This carrier relies upon tab-like gripping of the bottle directly adjacent the cap. The material of the carrier must be relatively stiff to hold the bottles and keep them in the array using a one-piece device. While this package presents a generally attractive and somewhat acceptable package, it does inherently have the disadvantage of potentially damaging or prematurely breaking the seal in the caps as the bottles are being removed.

Many other efforts to produce a multi-package for such bottles include a two-part device such as a band member around the periphery of the array in conjunction with a flexible resilient plastic member associated with and joining the necks of the bottles, such as typified in U.S. Pat. No. 3,653,504. A similar technique of joining the top regions of the bottles and individually encircling the bottom regions of the bottle with plastic band is shown in U.S. Pat. No. 4,109,787.

Co-pending application Ser. No. 542,879 shows a device similar to that described in this application with handle means generally lying on the longitudinal center line of the device and adapted to extend upwardly of the plane of the device on either side of the middle rank of bottles.

SUMMARY OF THE INVENTION

The carrier of the device of the present invention is particularly designed for packaging bottles or the like in closely spaced parallel rows. The package created by the device of this invention is a compact array of bottles which are unitized by a single resilient sheet-like device positioned generally midway of the body portion of each bottle. The device is thus particularly designed to include finger gripping means which extend upwardly from the plane of location of the device on the bottles to a position which will provide a user or handler of such a package with a suitable handle even though the device is situated directly adjacent the neck regions of the bottles.

Thus, the unique advantage of the package and the device of this invention is the utilization of a single sheet of resilient plastic flexible material which includes a plurality of apertures equal in number to the bottles to be packaged, dimensioned to frictionally and resiliently grip the body regions of the bottle. The device uniquely includes handle means formed in the flat sheet extending into diagonally opposed apertures in the end and most ranks of apertures. The handles will automatically protrude upwardly as bottles are moved into the apertures. Since the handles are not located on the longitudinal center line of the device an application technique which uses a central plow or blade as shown in U.S. Pat. No. 4,250,682 can be utilized.

An object of the invention is thus to present a multi-package of bottle-like containers which includes a carrier device positioned midway the body portions of the containers but still affording a suitable finger-gripping means.

A further object of the invention is to provide a multi-package of bottles that is convenient to handle and incorporates a one-piece plastic device which reduces the pendulum or swinging effect of bottles being carried thereby.

An advantage of the present device is the configuration of a flat carrier device which permits a handle means to be situated wholly within the periphery of diagonally opposite apertures which creates advantages force transmitting vectors on the package.

The above and other object of the invention will be apparent and fully pointed out in the detailed description and the accompanying drawings in which.

DETAILED DESCRIPTION OF THE PREFERRED EMBODIMENT

Figure 1:
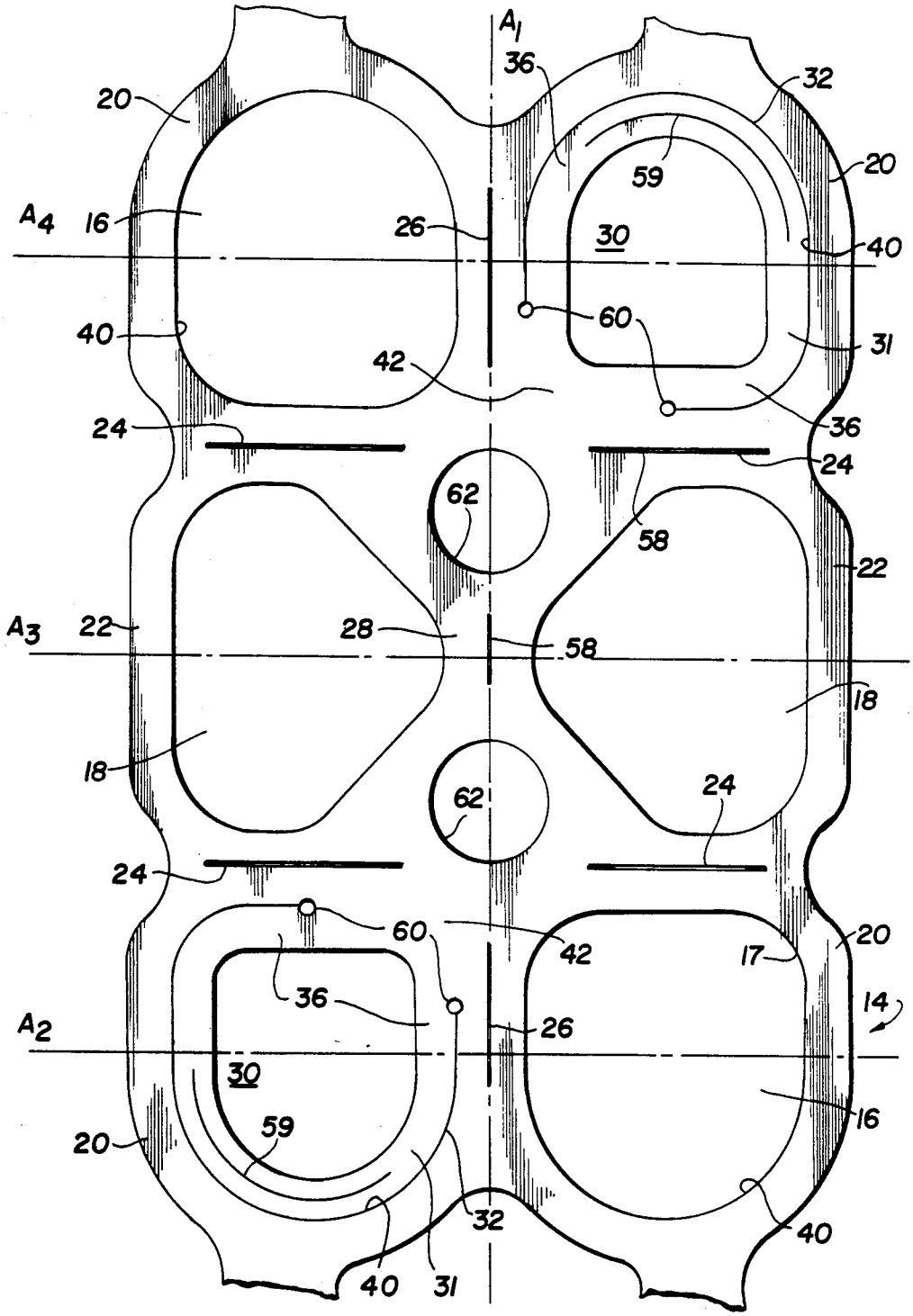
FIG. 1 is a plan view of the preferred embodiment of the carrier device of this invention.

Referring to the accompanying drawings and in particularly FIG. 1 at this time, one form of a carrier blank is shown before packaging the bottles. The blank or device 14 includes a plurality of apertures 16 and 18 arranged generally in ranks and rows and created by a series of interconnected bands 20 and 22.

In order to more clearly define the structural features of this invention, it is important to refer to various axes in the device. A longitudinal axis A1 is shown to bisect the device in a longitudinal direction. A plurality of lateral or rank axis bisect each rank and more particularly the outer band region of each rank. These rank axis are shown as A2, A3 and A4. With the axes thus defined it should be apparent that lateral webs 26 and 28 are situated on the longitudinal axis A1 and connect adjacent pairs of apertures in a given rank while longitudinal webs 24 connect adjacent pairs of apertures in a given row.

A plurality of row axis (not shown) are defined as bisecting each row in a manner similar to the description of the rank axis. Each aperture is therefore defined as including quadrents which extend between the intersection of rank and row axes with bands 20 and 22.

While the configuration of apertures 16 and 18 are dissimilar, this feature is not critical to the invention as claimed herein. It should also be noted that the apertures in the end ranks, namely apertures 16, are designed to have a peripheral extent, defined by the inner margin of the band 20, to be less than the peripheral extent of the cylindrical body portion of the container to be associated therewith. It should also be noted that each of the apertures 16 in a pair of interconnected end rank apertures are also dissimilar from one another. In diagonally opposed end rank apertures a handle means 31 is created to extend across the aperture which is primarily defined by the inner margin 40. Each of the apertures thus created in each of the end rank bands are essentially similar in peripheral extent and general configuration as if the handle 31 were not present.

These handle means 31 are essentially created by a slit 32 which forms simultaneously the inner margin 40 of the aperture and the outer edge of the handle means 31. The handle means 31 can be broadly described as including a pair of leg members 36 connected to band 20 through a hinge means 42. It is particularly to be noted that this hinge 42 is located generally in a quadrent of aperture 16 lying between longitudinal web means 24 and lateral web means 26 associated with the appropriate band 20. Thus the hinge connection 42 is positioned at the innermost quadrent relative to the outer periphery of the device.

Figure 2:
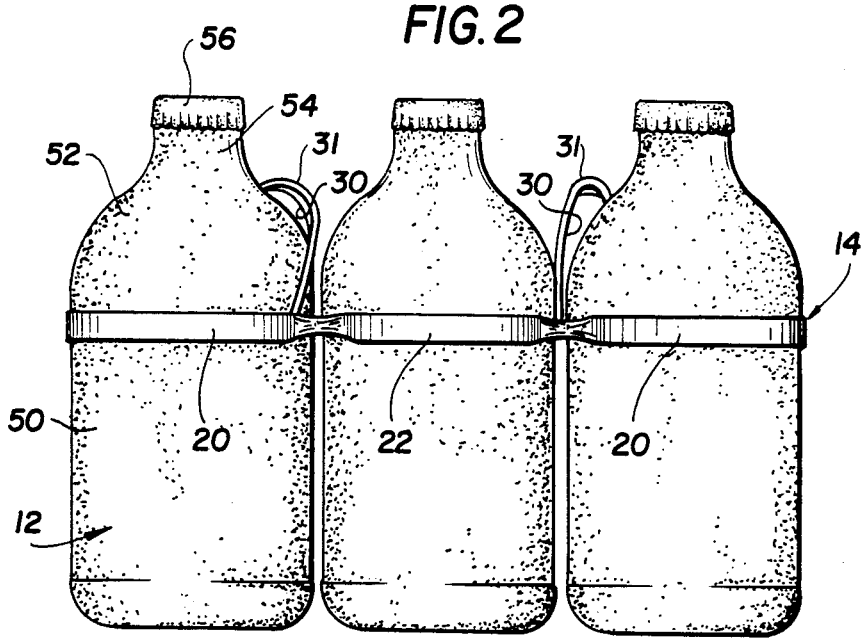
FIG. 2 is a side view of the multi-package which includes the device shown in FIG. 1.
Figure 3:
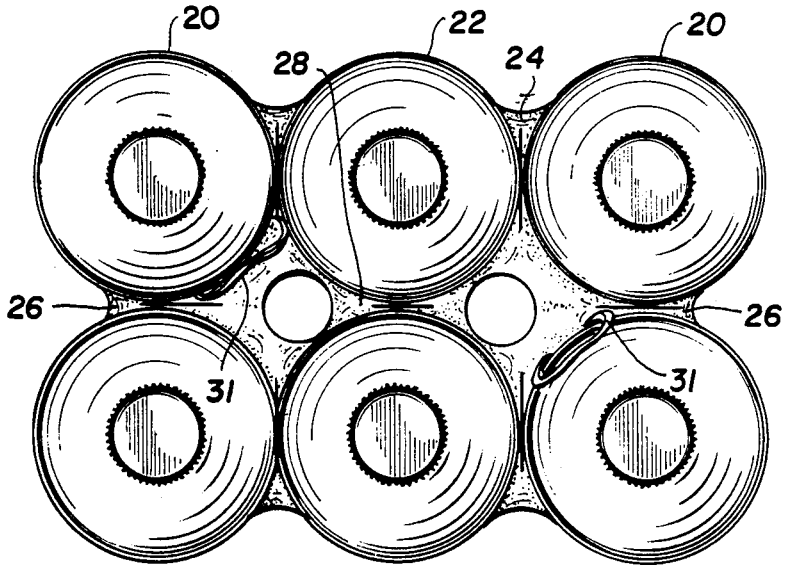
FIG. 3 is a top plan view of the multi-package incorporating the packaging device of FIG. 1.

In operation an array of bottles, preferably six, are placed beneath a succession of devices 14 and each successive device 14 and array of bottles 12 telescopically associated with one another. As the bottles that are to be associated with the diagonally opposed end rank apertures move upwardly suitable means, not shown, enable the handle 31 to be pushed up out of the aperture and into the arrangement shown in FIGS. 2 and 3. The aperture 30 that is designed to receive a finger is thus smaller than aperture 16 and significantly smaller than the perimeter of the cylindrical body portion of the bottle. The band that creates the handle 31 is advantageously frangibly secured to margin 40 to facilitate winding and handling.

With such arrangement a carrier applying mechanism which utilizes a longitudinally central plow or blade can force the carrier bands 20 and 22 down to a position generally midway of the body of the containers to provide the necessary frictional holding power and holding stability for the package.

In use the handle may be comfortably be grasped by one hand by putting one finger between each of the ranks and gripping the aperture 30 formed in the handle. Bend or impression lines 59 create a suitable comfortable feeling for such a handle.

An advantageous feature of the diagonal location of these handles is that when the package is grasped with one hand a vector of force is applied to the associated bands 20 that is directed both upwardly and inwardly. This combined vector when applied to the innermost quadrent of the holes tends to more securely hold the bottle associated with the handle aperture by forcing the outermost band regions into more firmly compressed association the bottle. This force, is preferred to a purely vertical or peel force applying vector.

Features such as apertures 62 created adjacent the central web 28 reduce the material weight of the carrier and contribute towards the creation of individual bands holding each bottle. Further depressions 58 facilitate the pivoting and isolate the band-like application surrounding the bottles.

Each bottle 12 is shown to include a body region 50 joined to a neck region 54 of greatly reduced diameter by a transitional shoulder means 52. The neck regions does include an opening 56 with any suitable cap or seal means.

It will be understood that there are other variations and modifications that may be affected without departing from the spirit and scope of the novel concept disclosed and claimed herein.

I claim:

1. In a package which includes a package making device for unitizing a plurality of containers having a cylindrical body region and reduced diameter neck portion terminating with a dispensing opening, the device formed from a resilient elastic deformable sheet of plastic material and comprising at least two rows and three ranks of integrally connected bands creating reconfigurable container receiving and gripping apertures, the bands surrounding and frictionally engaging the cylindrical body region of each container, a longitudinal axis defined substantially midway between the lateral edges of the device, the rows being situated on opposing sides of said longitudinal axis, a plurality of rank axes perpendicularly disposed to said longitudinal axis, lateral web means lying on the longitudinal axis integrally connecting pairs of adjacent apertures in a given rank, longitudinal web means integrally connecting pairs of adjacent apertures in a given row, a pair of finger gripping loops each extending from the inner margin of diagonally opposite apertures in the end ranks of the device, each loop emanating from and secured by hinge means in the innermost quadrant of said diagonally opposed end rank apertures, the innermost quadrant extending between the lateral and longitudinal web means associated with said diagonally opposite apertures, said hinge means defined as including two extremities lying on either side of an imaginary line that divides the innermost quadrent into two substantially equal segments, the finger gripping loops thus being configured and arranged so that they extend across the associated aperture in the plane of the carrier device prior to application with the bottle-like containers and extend upwardly to the plane of the device responsive to the association of a container with the aperture.

2. The package making device of claim 1 wherein each finger gripping loop includes an aperture of sufficient size to receive a finger, said finger receiving aperture being of less perimeter than the perimeter of the associated container receiving aperture, the container receiving aperture being of less perimeter than the perimeter of the cylindrical body region of the container.

3. The package making device of claim 2 wherein the finger receiving aperture is, at least in part surrounded and defined by bands, the outer periphery of which is frangibly secured to the inner periphery of the associated container receiving apertures.

4. The package making device of claim 3 wherein the finger receiving band as coined in the region of the band which is furthest removed from the hinge means.

* * * * *